US005558067A

United States Patent [19]

Blizard et al.

[11] Patent Number: 5,558,067

[45] Date of Patent: Sep. 24, 1996

[54] DOUBLE PULSING ELECTRONIC UNIT INJECTOR SOLENOID VALVE TO FILL TIMING CHAMBER BEFORE METERING CHAMBER

[75] Inventors: Norman C. Blizard; Paul D. Free, both of Columbus, Ind.

[73] Assignee: Cummins Engine Company, Inc., Columbus, Ind.

[21] Appl. No.: 518,987

[22] Filed: Aug. 24, 1995

[51] Int. Cl.[6] ..... F02M 37/04

[52] U.S. Cl. ..... 123/501; 123/446

[58] Field of Search ..... 123/446, 447, 123/500, 501, 357, 467

[56] References Cited

U.S. PATENT DOCUMENTS

| | | | |
|---|---|---|---|
| 4,396,151 | 8/1983 | Kato et al. . | |
| 4,402,456 | 9/1983 | Schneider . | |
| 4,418,867 | 12/1983 | Sisson . | |
| 4,463,725 | 8/1984 | Laufer | 123/446 |
| 4,531,672 | 7/1985 | Smith | 123/446 |
| 4,951,631 | 8/1990 | Eckert . | |
| 4,976,244 | 12/1990 | Eckert | 123/501 |
| 5,040,511 | 8/1991 | Eckert . | |
| 5,067,464 | 11/1991 | Rix | 123/446 |
| 5,072,709 | 12/1991 | Long | 123/446 |
| 5,320,278 | 6/1994 | Kolarik | 123/446 |
| 5,333,786 | 8/1994 | Gant | 123/501 |
| 5,377,636 | 1/1995 | Rix | 123/446 |
| 5,404,855 | 4/1995 | Yen | 123/446 |
| 5,460,133 | 10/1995 | Perr | 123/446 |

OTHER PUBLICATIONS

Ronald B. Lannan and Albert E. Sisson, "Cummins Electronic Controls for Heavy Duty Diesel Engines", International Congress on Transportation Electronics Proceedings, Oct. 17–18, 1988, pp. 277–294, Library of Congress Catalog Card No. 87–83470.

*Primary Examiner*—Carl S. Miller

*Attorney, Agent, or Firm*—Woodard, Emhardt, Naughton Moriarty & McNett

[57] ABSTRACT

An electronic fuel injector includes a metering chamber defined by a metering piston and the sides and bottom of a bore defined within the injector body, and a timing chamber defined by the metering piston, the bore sides and a timing plunger slidably disposed within the bore. A biasing spring is connected to opposing surfaces of the timing plunger and metering piston for biasing the metering piston away from the timing plunger. The metering chamber is in constant fuel communication with a pressurized fuel source and the timing chamber receives fuel from the fuel source according to the actuation of a solenoid actuated control valve disposed therebetween. A fueling strategy for such an injector requires actuating the control valve to substantially fill the timing chamber before filling the metering chamber, for subsequent injection into the engine, when the force of the biasing spring is at a minimum.

10 Claims, 4 Drawing Sheets

DOUBLE PULSING ELECTRONIC UNIT INJECTOR SOLENOID VALVE TO FILL TIMING CHAMBER BEFORE METERING CHAMBER

BACKGROUND OF THE INVENTION

This invention relates in general to fuel injectors for an internal combustion engine and more specifically to an electronic fuel injector in which the timing chamber is filled with fuel before filling the metering chamber.

Electronic fuel injectors are frequently used in today's internal combustion engines. The electronic fuel injector provides precise and reliable fuel delivery into the cylinder of compression ignition and spark ignition engines. The precision and reliability of the electronic fuel injector has contributed to the goals of fuel efficiency, maximum practicable power output and control of undesired products of combustion. These and other benefits of electronic fuel injection systems are well-known and appropriately used to beneficial effect and the design of modern internal combustion engines.

In recent years, electronically controlled fuel injectors have found applications in the heavy duty engine market and, more particularly, the diesel engine market. An example of a system utilizing electronic fuel injectors is the CELECT Engine Control System manufactured by Cummins Engine of Columbus, Indiana and available with their N-14 engine, as well as other engine models. In this system, an electronic fuel injector, such as the injector 5 shown in FIG. 1 for example, is used to implement various CELECT fueling strategies. As is known in the art, the injector body 10 is connected to a nozzle assembly 22 via a nozzle retainer 36. A timing chamber 26 is defined by a portion of the central cylindrical bore 14, the lower exposed surface of the timing plunger 16 and the upper exposed face of the metering piston 17. A metering barrel 34 is located between the interior portions of the injector body 10 and nozzle assembly 22. A metering chamber 33 is defined by a cylindrical bore 15 of the metering barrel 34, the lower exposed surface of the metering plunger 17 and the upper exposed surface of a nozzle spacer 23. The timing plunger 16 protrudes into the base of a central cylindrical bore 18 but is not mechanically coupled to the coupling member 20. The coupling member 20 abuts the timing plunger 16 such that only a compressive load may be transferred from the coupling member 20 to the timing plunger 16.

The coupling member 20 is equipped with an annular stop 65, located at the bottom end of the coupling member 20. The stop 65 limits the translation of the coupling member 20 in the direction of the injection stroke. Extending further radially outward on a flange 72 of the coupling member 20 is a spring seat 66, through which a return spring 68 acts upon the coupling member 20 biasing it upward in the direction of the retraction stroke. The opposite end of the return spring 68 acts upon a spring seat 70, located on the injector body 10 at the base of a collar 74.

At the exposed end of the coupling member 20, pocket 76 and a bearing surface 80 are formed, upon which a link 78 acts to force coupling member 20 against the force created by the return spring 68 during the injection stroke. The link 78 is typically in direct or indirect contact with the injection train cam shaft (not shown) and reciprocates along the central axis of injector assembly 5 in response to the angular rotation of the actuating cam (not shown). Thus, rotational motion of the cam shaft is converted into reciprocal motion of the injector assembly 5 axial components so as to provide force useful in pressurizing the timing chamber 26 and, ultimately, the metering chamber 33.

The fuel inlet port 45 is in communication with two separate fuel inlet branches. The first branch communicates the port 45 to the metering chamber 33 through a metering inlet 49 and check valve 35. The second branch communicates the port 45 to a control chamber 54, and ultimately the timing chamber 26, through a control inlet passage 47. Fuel flow from the control chamber 54 to the timing chamber 26 is accomplished by allowing the fuel to flow through the control valve 56, a control passage 50, a plunger chamber control orifice 48, and a plunger chamber passage 46 formed by an annular gap between the timing plunger 16 and the central cylindrical bore 14.

The basic operation of the injector is well-known in the art. A predetermined quantity of fuel is metered into injector assembly 5 during a retraction stroke and injected into the engine during an injection stroke. Fuel metering is controlled by the movement of the timing plunger 16, the metering piston 17, and the opening of a control valve 56 of the control solenoid 58. At the start of the retraction stroke (as shown in FIG. 1), the timing plunger 16 is substantially bottomed against the metering piston 17, the metering piston 17 is bottomed against the nozzle spacer 23 and the control valve 56 is closed.

As the fuel enters the injector body 10, fuel at rail pressure of 150 psi passes through the inlet passage 49 and opens the check valve 35 and enters the then very small volume of the metering chamber 33. The pressure of the fuel acting on the bottom of the metering piston 17 within metering chamber 33 forces metering piston 17 upward, thus creating additional pressure in timing chamber 26. As the cam profile allows the link 78 and the coupling member 20 to move upward under the urging of the spring 68 the pressure in timing plunger chamber 26 acts on the bottom surface area of timing plunger 16 thereby causing both the timing plunger 16 and metering piston 17 to independently move upward, with timing plunger 16 maintaining contact with coupling member 20. Fuel continues to flow through the check valve 35 into the expanding volume of metering chamber 33 as long as the control valve 56 is closed, which prevents fuel flow through the passage 50, the orifice 48 and the passage 46 into the collapsed timing chamber 26. When the control solenoid 58 is actuated by well-known means, the control valve 56 is commanded open and the metering of fuel into metering plunger chamber 33 ceases. This is accomplished by supplying fuel, also at rail pressure of 150 psi, from the control chamber 54, through the control valve 56, the passage 50 and the orifice 48, and the passage 46 into the timing chamber 26, thereby causing equal pressures to exist in both the timing chamber 26 and the metering chamber 33. Equal pressures acting on both ends of the metering piston 17 tends to stop its upward motion. Thus, a fixed and predetermined amount of fuel will remain in the metering chamber 33.

A bias spring 55, located within the timing chamber 26 and bearing against the opposing surfaces of the timing plunger 16 and the metering piston 17, ensures that the metering piston 17 remains stationary and does not drift up as the timing chamber 26 fills with fuel thereby continuing to force the timing plunger 16 upward. At the beginning of the retraction stroke, when the timing plunger 16 is bottomed against the metering piston 17, the spring 55 exerts a bias on these opposing surfaces of approximately 40 psi. As the timing chamber 26 fills with fuel, thereby causing the timing plunger 16 to move away from the metering piston 17, the biasing force of spring 55 decreases linearly. When the timing plunger 16 is maximally displaced from the metering piston 17 at the end of the retraction stroke, the bias of spring 55 is approximately 20 psi. Thus, at the end of the retraction stroke, the bias of spring 55 reduces to approximately 50% of its bias value at the beginning of the retraction stroke. The spring 55 also exerts enough force on the check valve 35, through the metering piston 17 and the hydraulic link created by the fuel located in the metering chamber 33, to keep the check valve 35 seated, preventing any change in the volume of fuel contained in the metering chamber 33. Thus, a precisely metered quantity of fuel is trapped in the metering chamber 33. This fuel is the quantity of fuel that will be injected into the engine during the subsequent injection stroke. As the retraction stroke continues, the timing plunger 16 continues to rise and the timing plunger chamber 26 continues to be filled with fuel at rail pressure until the end of the retraction stroke.

Details of the injection stroke including timing spill 106, start of injection 107 and end of injection 108, are not germane to the present invention, although a complete explanation may be found in U.S. Pat. No. 5,067,464, issued Nov. 26, 1991 to Rix, et al. herein incorporated by reference.

Referring to FIG. 2, a timing diagram of this well-known fuel strategy is shown. Under normal operation, the control valve 56 is closed at the beginning of the retraction stroke 110, thereby inhibiting the passage of fuel to the timing chamber 26. The fuel rail pressure of 150 psi is more than adequate to overcome the bias on spring 55 so that fuel enters the metering chamber 33 and displaces both the metering piston 17 and the timing plunger 16 away from the metering chamber 33. This initiates the start of metering 102. When a predetermined quantity of fuel has entered the metering chamber 33, the control valve 56 opens and permits fuel, at rail pressure of 150 psi, to enter the timing chamber 26. Since the pressure in the timing chamber 26 is now equal to the pressure in the metering chamber 33, the upward motion of the metering piston 17 ceases, thereby trapping in the metering chamber 33, the predetermined quantity of fuel to be injected into the engine during the injection stroke. This opening of the control valve 56 thus signals the end of metering 103. As the injector assembly 5 continues through its retraction stroke, the timing plunger 16 is forced by incoming fuel to continue moving away from the metering chamber 33. This portion of the retraction stroke is known as timing fill 105. At the end of the retraction stroke 106, the metering chamber 33 holds a predetermined amount of fuel to be injected into the engine and the timing chamber 26 holds a quantity of fuel defined by the top of the metering piston 17 and the bottom of the timing plunger 16.

A problem with the CELECT fuel system is known to occur during cranking at start up and at low rpm operation. When the N-14 engine operates at less than 1000 rpm, the fuel pressure may be less than 40 psi due to internal leakage. This may be inadequate to overcome the bias of spring 55 at the beginning of the retraction stroke and could therefore result in inadequate fueling during start up and operation below 1000 rpm. To address this problem, the N-14 uses a large fuel pump (1.25" PTG-based) and the CELECT strategy calls for full fueling (350 $mm^3$/stroke). However, this strategy results in uncontrolled smoke and emissions during start up. Preliminary estimates indicate that this uncontrolled start up mode accounts for approximately 12% of particulate emissions as measured on the EPA cycle. Moreover, estimates of fueling required for N-14 start up are in the range of 100 $mm^3$/stroke. Thus the actual fueling strategy overfuels the engine during cranking and start up and at engine speeds of less than 1000 rpm.

If metering could occur later during the retraction stroke, when the load on bias spring 55 is near 20 psi, controlled volumetric metering of fuel into metering chamber 33 could be accomplished. Such a fueling strategy would result in better smoke and particulate control during start up, since a precise quantity of fuel could be metered during the retraction stroke. Moreover, a smaller gear pump (0.75–1.00" PTG-based) may be adequate to supply fuel through the full operating range. A smaller and thus lower cost pump would be desirable if it could meet the cranking flow requirements. Finally, late metering may be advantageous in that it reduces the control delay between commanded fueling and combustion, thereby enabling a more precise control over speed, torque, emissions and smoke.

SUMMARY OF THE INVENTION

The present invention contemplates an injector fueling system where, under certain prescribed conditions, fuel metering occurs late in the retraction stroke. In accordance with the invention, the injector is of the type having a bore formed in the injector body, and a timing plunger and metering piston slidably disposed therein. A timing chamber is defined in the bore between the timing plunger and metering piston. A metering chamber is further defined in the bore below the metering piston. A spring is connected between the timing plunger and the metering piston for biasing the metering piston away from the timing plunger. The biasing force of the spring increases as the metering piston moves toward the timing plunger and decreases as the metering piston moves away from the timing plunger. A passage is formed in the injector body for providing continuous fuel communication to the metering chamber from the fuel source and a control valve is provided for either permitting or inhibiting the passage of fuel into the timing chamber.

At the beginning of the retraction stroke, the metering piston is essentially bottomed in the metering chamber and the timing plunger is essentially bottomed against the metering piston. Thus, both the metering chamber and the timing chamber have minimum volumes at the beginning of the retraction stroke.

According to one aspect of the present invention, the control valve is commanded open coincident with the start of the retraction stroke, and since fuel entering the timing chamber is at the same pressure as the fuel source, the metering piston stays bottomed in the metering chamber and no fuel enters the metering chamber. Instead, fuel enters the timing chamber causing the timing plunger to rise in the bore thereby decreasing the force of the biasing spring. As the injector nears the end of its retraction stroke, the control valve is commanded close. Since the timing chamber is now isolated from the pressure of the fuel source, the pressure of fuel against the bottom of the metering piston causes the piston to move upward, thereby permitting a predetermined quantity of fuel to be metered into the metering chamber. Since the timing plunger has been displaced away from the metering piston for most of the retraction stroke by the filling of the timing chamber, tile spring bias near the end of the retraction stroke should be decreased by approximately 50%. Lower fuel pressure is thus able to move the metering piston and thereby fill the metering chamber with the predetermined quantity of fuel needed for low rpm operation.

Another object of he present invention is to provide a method of metering a predetermined quantity of fuel into such a fuel injector for subsequent injection into an internal combustion engine. Tile method comprises the steps of: (a) determining the engine rpm; (b) performing the steps (c)–(f) so long as said engine rpm is less than a predetermined value; (c) determining the beginning of the retraction stroke; (d) enabling the control means to deliver pressurized fuel to the timing chamber at the beginning of the retraction stroke; (e) disabling the control means from delivering pressurized fuel to the timing chamber near the end of the retraction stroke thereby enabling fuel to enter the metering chamber; and (f) enabling the control means to deliver pressurized fuel to the timing chamber after a predetermined value of fuel has been metered into the metering chamber.

These and other objects of the present invention will become more apparent from the following description of the preferred embodiment.

DESCRIPTION OF THE PREFERRED EMBODIMENT

Figure 1:
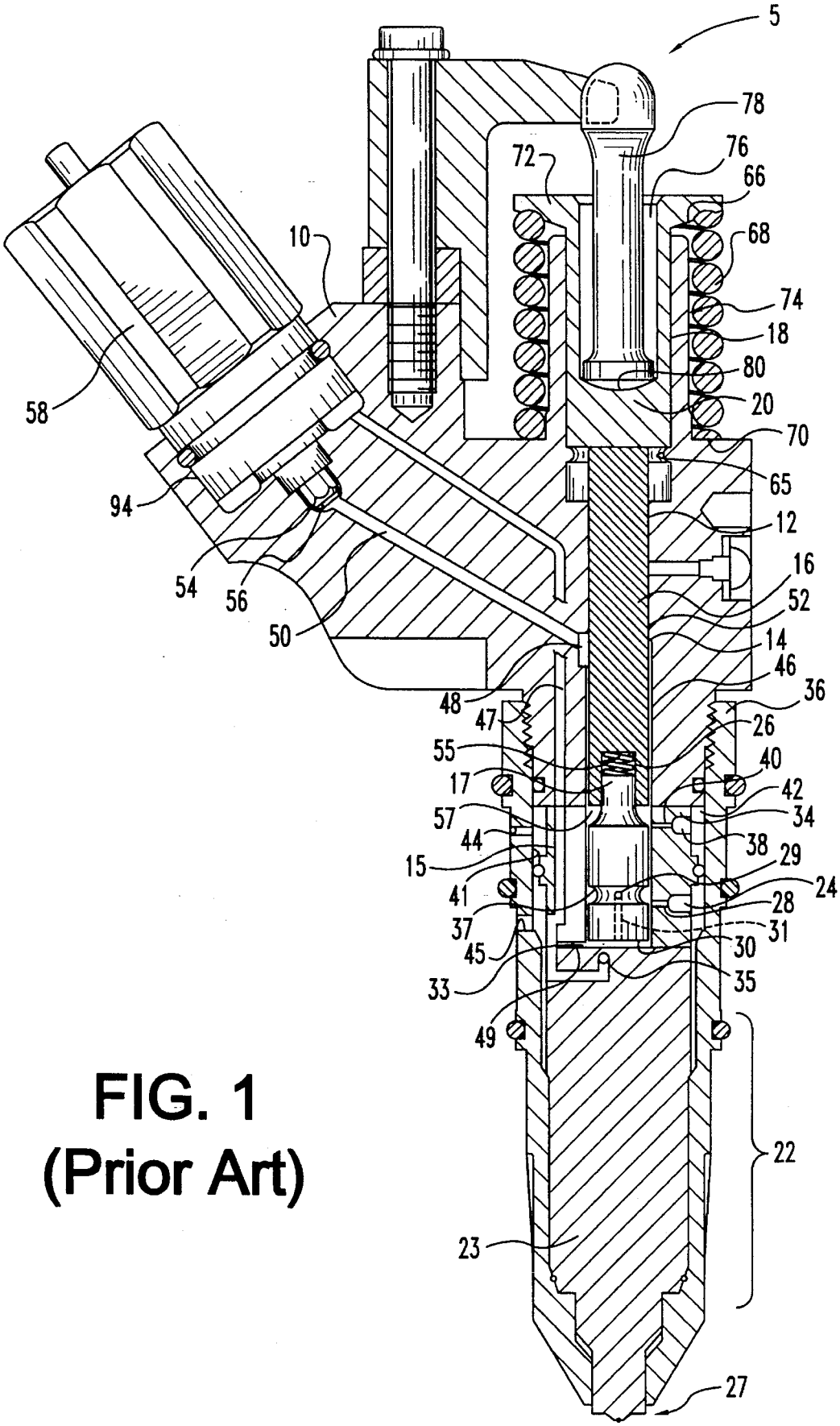
FIG. 1 (Prior Art)
FIG. 1 is a cross-sectional view of an electronic fuel injector of known design for which the fueling strategy of the present invention is adapted to actuate.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The present invention, in the preferred embodiment, contemplates a new fueling strategy for an electronic fuel injector of the type shown in FIG. 1. However, it is understood that other fuel injectors experiencing the problem addressed by the present invention, as discussed in the background of the invention, are contemplated for use with the fueling strategy of this invention.

Figure 3:
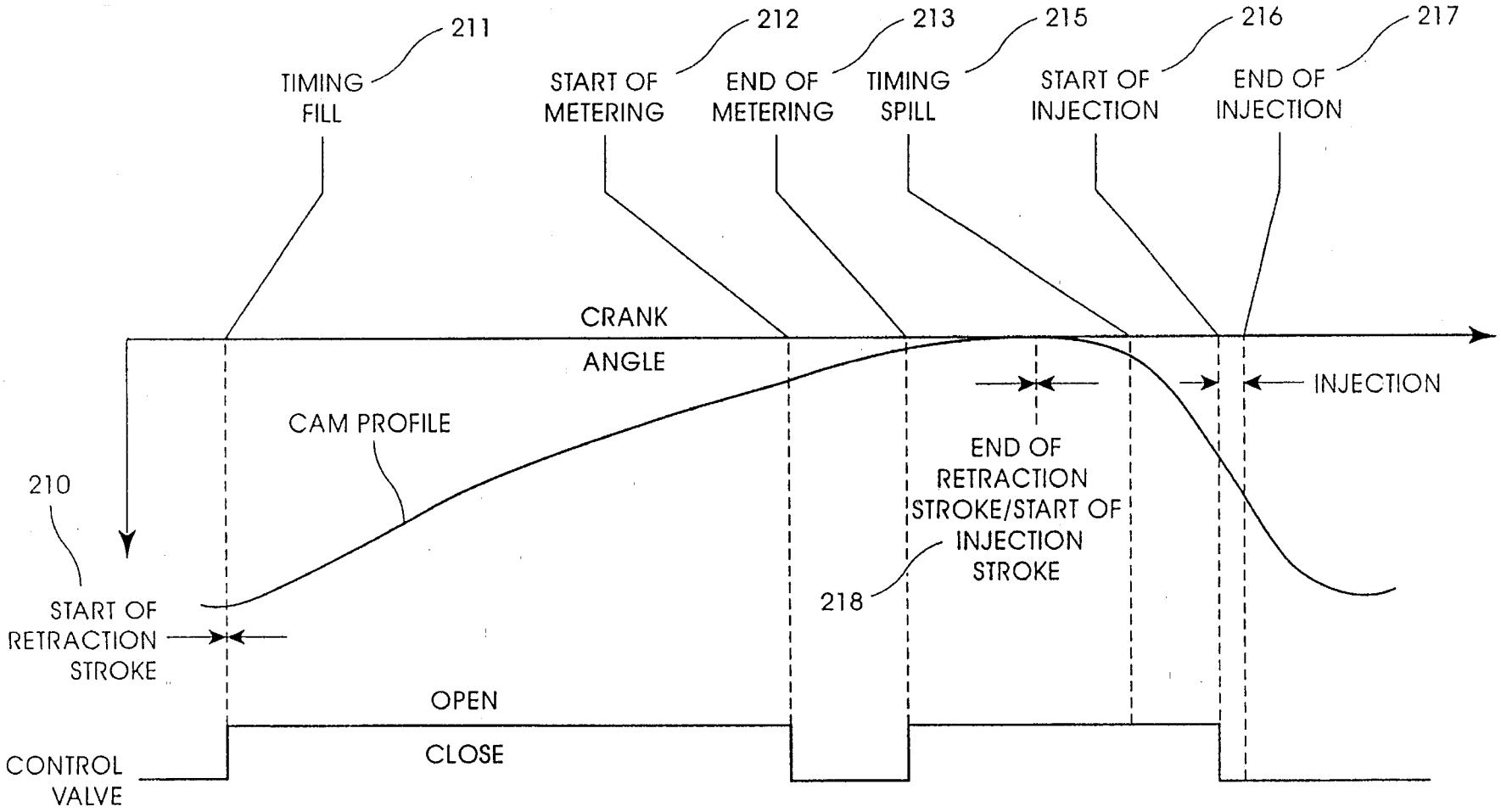
FIG. 3 is a timing diagram showing the fueling strategy of the present invention to be used with the electronic fuel injector of FIG. 1.
Figure 4:
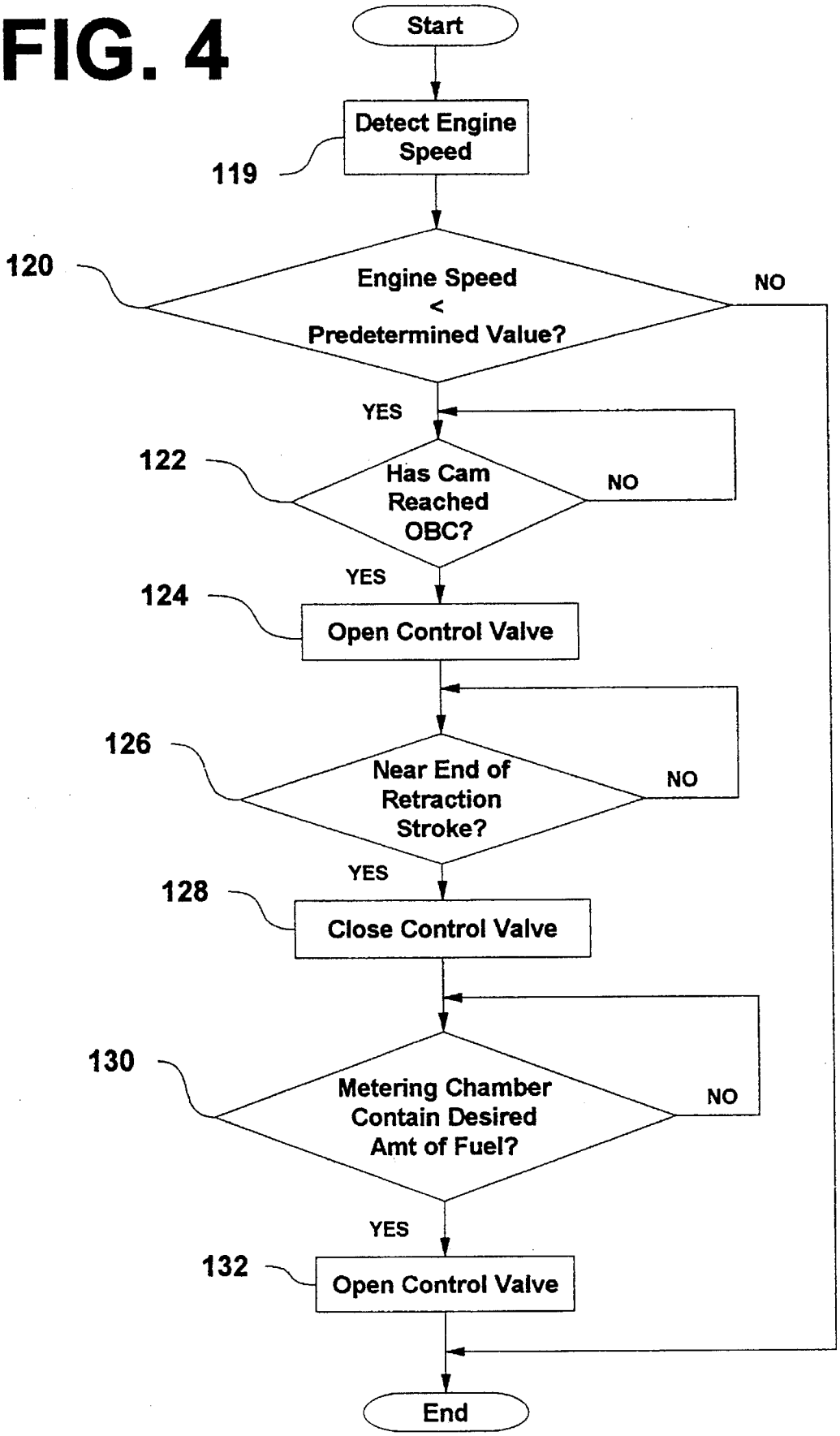
FIG. 4 is a flow chart showing the sequence of the steps to be performed in fueling the electronic fuel injector of FIG. 1 according to the timing diagram of FIG. 3.

In accordance with the preferred embodiment of the invention, a fueling strategy for the retraction stroke of an electronic fuel injector is provided, as shown in FIGS. 3 and 4. Referring to the structural components of FIG. 1 and the timing components of FIG. 3, the control valve 56 is commanded open at the beginning of the retraction stroke 210. Since the fuel entering the timing chamber 26 is at the same pressure as the fuel in inlet passage 49, the metering piston 17 stays bottomed in the metering chamber 33 and no fuel enters the metering chamber 33. Instead, fuel enters the timing chamber 26, initiating the timing fill 211 portion of the retraction stroke. Since the timing plunger 16 is not mechanically connected to coupling member 20, low pressure fuel will cause the timing plunger 16 to maintain contact with coupling member 20 as it retracts from the bore 18 under the pressure of the return spring 68. The upward motion of timing plunger 16 is further assisted by the bias of spring 55. In the preferred embodiment, the bias of spring 55 at the beginning of the retraction stroke is approximately 40 psi.

As the injector nears the end of its retraction stroke, the control valve 56 is commanded closed thereby initiating the start of metering 212. Since no fuel can enter the timing chamber 26, the pressure of fuel against the bottom of the metering piston 17 through the inlet passage 49 causes the piston 17 to keep the timing plunger 16 in contact with the retracting coupling member 20, thereby permitting a predetermined quantity of fuel to be metered into a metering chamber 33 only if the fuel pressure is high enough to overcome the bias on spring 55. However, because of the timing chamber 26 has been filling since the beginning of the retraction stroke, and because no fuel has yet entered the metering chamber 33, the bias on spring 55 near the end of the retraction stroke should be substantially reduced. In the preferred embodiment, the bias on spring 55 at the end of the retraction stroke, when the timing plunger 16 is maximally displaced from the metering piston 17, is approximately 20 psi. Thus, the present invention contemplates that the bias on spring 55 will be reduced, at the end of the retraction stroke, to approximately 50% of its biasing force at the beginning of the retraction stroke. This fueling strategy thus requires lower fuel pressure to fill the metering chamber 33 than the fuel pressure required by the conventional fueling strategy. Since the fuel pressure at startup and low rpm operation is adequate to overcome the reduced spring bias, overfueling of the metering chamber 33 is no longer necessary to guarantee start up and low rpm engine operation. Thus, the fueling strategy of the present invention permits the metering chamber 33 to be filled with a more precise quantity of fuel needed for start up and low rpm operation. In the preferred embodiment, this quantity is 100 $mm^3$/stroke, but quantities in the range of 5–350 $mm^3$/stroke are contemplated. At or near the end of the retraction stroke, the control valve 56 is commanded open, thereby causing the end of metering 213 in the same manner as discussed in the background of the invention.

Figure 2:
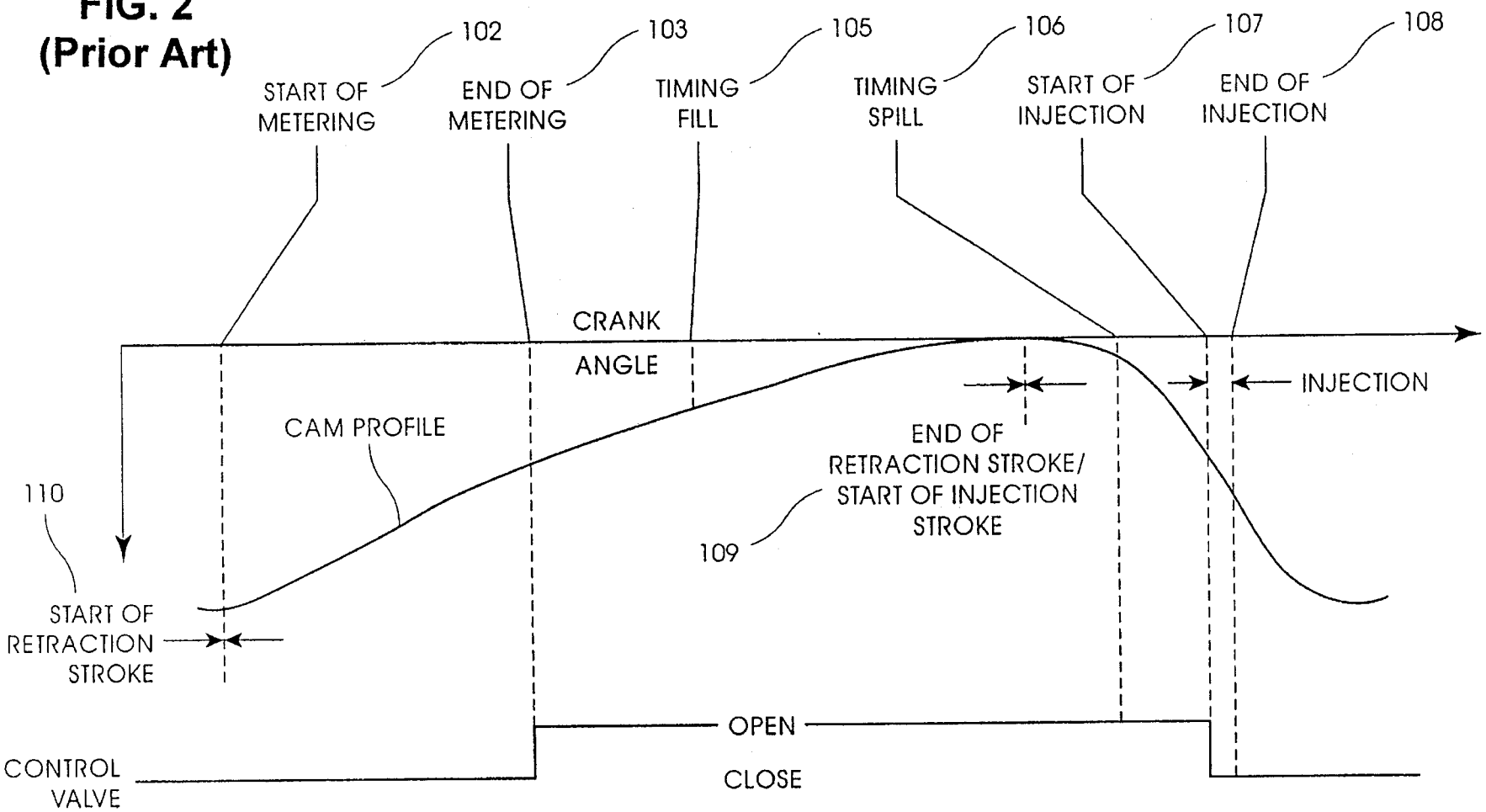
FIG. 2 (Prior Art)
FIG. 2 is a timing diagram showing a known fuel strategy used with the electronic fuel injector of FIG. 1.

The timing spill 215, start of injection 216 and end of injection 217 remain unchanged from the fueling strategy shown in FIG. 2.

Referring now to FIGS. 3 and 4 (and to FIG. 1 for the structural components), a flow chart of the algorithm for implementing the fueling strategy of the present invention during the retraction stroke of an electronic fuel injector, such as the injector shown in FIG. 1, is shown. At step 119, the engine speed is determined using known techniques. At step 120, the engine speed is tested. If the engine speed is below a predetermined value, the fueling strategy of the present invention is executed. In the preferred embodiment this predetermined level is 100 rpm, but the invention contemplates predetermined levels in the range of 50–150 rpm. If the engine speed is at or above the predetermined level, the algorithm of FIG. 4 is bypassed.

At step 122, the algorithm determines the beginning of the retraction stroke 210 from the cam position using known techniques. When the retraction stroke begins, control valve 56 is commanded open at step 124, thereby enabling delivery of fuel to the timing chamber 26 and commencing timing fill 211. At step 126, the algorithm tests whether enough time has elapsed within the retraction stroke to commence the start of metering 212. The time length of the retraction stroke at any given engine speed may be determined using known methods. Thus, the only constraint on the start of metering 212 is that sufficient time must be allowed within the remaining retraction stroke to meter the desired quantity of fuel into the metering chamber 33. At the desired point near the end of the retraction stroke 218, the algorithm, at step 128, commands the control valve 56 closed thereby enabling fuel to enter the metering chamber 33 and commencing the start of metering 212. At step 130, the algorithm tests whether enough time has elapsed within the metering phase of the retraction stroke to fill the metering chamber 33 with the desired volume of fuel. If not, the metering chamber 33 continues to fill with fuel. When the metering chamber 33 contains the desired volume of fuel, the algorithm, at step 132, commands the control valve 56 open thereby establishing the end of metering 213. For the remainder of the retraction stroke, the timing chamber 26 continues to fill with fuel. Thus, in one embodiment, the end of metering 213 occurs before the end of the retraction stroke 218. In another embodiment, the end of metering 213 occurs coincident with the end of the retraction stroke 218, thereby delaying the metering of fuel into meteerin chamber 33 until the bias on spring 55 has decreased to its minimum value.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fuel injector having an injection stroke and a retraction stroke for use in an internal combustion engine, said injector comprising:

an injector body having a bore formed therein;

a timing plunger disposed at a first location within said bore, said timing plunger being freely slidable within said bore during the retraction stroke;

a metering piston slidably disposed at a second location within said bore;

a timing chamber defined in said bore between said timing plunger and said metering piston;

means for biasing said metering piston away from said timing plunger with a variable force;

a metering chamber defined in said bore below said metering piston, said metering chamber and said timing chamber having minimum volumes at the beginning of the retraction stroke, said volumes being increasable as said injector travels through the retraction stroke;

a passage formed in said injector body for providing continuous fuel communication to said metering chamber; and control means for permitting and inhibiting the passage of fuel into said timing chamber, wherein said control means permits the passage of fuel into said timing chamber at the beginning of the retraction stroke thereby forcing said timing plunger away from said metering piston and decreasing said biasing force of said biasing means, and further wherein said control means inhibits the passage of fuel into said timing chamber near the end of the retraction stroke thereby forcing a predetermined quantity of fuel into said metering chamber and causing said metering piston to move toward said timing plunger, whereby a predetermined quantity of fuel is metered into said metering chamber after said force of said biasing means has decreased, said predetermined quantity of fuel being thereafter injected into the engine during the subsequent injection stroke.

2. The fuel injector of claim 1, wherein said control means permits the passage of fuel into said timing chamber after said predetermined quantity of fuel has been forced into said metering chamber, but before the end of the retraction stroke.

3. The fuel injector of claim 2, wherein said biasing means has a first biasing force at the beginning of the retraction stroke, said biasing force decreasing to a second biasing force at the end of the retraction stroke.

4. The fuel injector of claim 3, wherein said forcing of a predetermined quantity of fuel into said metering chamber occurs just prior to said biasing means attaining said second biasing force during the retraction stroke.

5. The fuel injector of claim 4, wherein said means for biasing includes a spring disposed within said timing chamber, said spring being connected at one end to said timing plunger and at its opposite end to said metering piston.

6. The fuel injector of claim 5, wherein said first biasing force is approximately 40 psi and said second biasing force is approximately 20 psi.

7. A method of metering a predetermined quantity of fuel into a fuel injector during the retraction stroke for subsequent injection into an internal combustion engine at low engine rpm, wherein the injector includes a metering chamber in continuous fluid communication with a pressurized fuel source, a timing chamber, and control means for controlling the delivery pressurized fuel to either the timing chamber or the metering chamber, the method comprising the steps of:

(a) determining the engine rpm;

(b) performing the steps (c)–(f) so long as said the engine rpm is less than a predetermined value;

(c) determining the beginning of the retraction stroke;

(d) enabling said control means to deliver pressurized fuel to said timing chamber at the beginning of the retraction stroke;

(e) disabling said control means from delivering pressurized fuel to said timing chamber near the end of the retraction stroke thereby enabling fuel to enter said metering chamber; and (f) enabling said control means to deliver pressurized fuel to said timing chamber after a predetermined volume of fuel has been metered into said metering chamber.

8. The method of claim 7 wherein said predetermined engine rpm value is 1000 rpm.

9. The method of claim 8 including the step of determining the end of the retraction stroke, and wherein step (f) occurs coincident with the end of the retraction stroke.

10. The method of claim 8, wherein said predetermined volume of fuel is approximately 100 cubic mm.

* * * * *